US009440108B2

(12) United States Patent
Shearin-Brown

(10) Patent No.: US 9,440,108 B2
(45) Date of Patent: Sep. 13, 2016

(54) MULTIPURPOSE EXERCISE STOOL

(71) Applicant: Victoria Shearin-Brown, Woodbridge, VA (US)

(72) Inventor: Victoria Shearin-Brown, Woodbridge, VA (US)

( * ) Notice: Subject to any disclaimer, the term of this patent is extended or adjusted under 35 U.S.C. 154(b) by 52 days.

(21) Appl. No.: 14/444,752

(22) Filed: Jul. 28, 2014

(65) Prior Publication Data

US 2016/0023040 A1 Jan. 28, 2016

(51) Int. Cl.
*A63B 21/00* (2006.01)
*A63B 22/06* (2006.01)

(52) U.S. Cl.
CPC ..... *A63B 22/0605* (2013.01); *A63B 21/1465* (2013.01); *A63B 21/1469* (2013.01)

(58) Field of Classification Search
USPC ..... 482/1–148
See application file for complete search history.

(56) References Cited

U.S. PATENT DOCUMENTS 321,157 A 6/1885 Tate
1,961,530 A * 6/1934 Spanenberg ..... B60N 2/39 248/577
3,863,587 A * 2/1975 Bosnich ..... B63B 29/12 114/191
5,460,586 A * 10/1995 Wilkinson ..... A63B 22/0012 482/118
5,470,297 A * 11/1995 Park ..... A63B 21/0084 482/127
6,656,098 B2 * 12/2003 Hoffman ..... A61H 1/0218 128/845
6,726,607 B1 * 4/2004 Ihli ..... A63B 21/015 482/115
6,887,190 B1 * 5/2005 Azari ..... A63B 21/04 482/123
7,115,078 B1 * 10/2006 Kalember ..... A63B 21/015 482/117
7,160,234 B2 * 1/2007 Dise ..... A61H 1/0218 482/142
7,811,215 B2 10/2010 Wallach
8,167,667 B2 * 5/2012 Sturm ..... B63B 7/085 440/21
8,408,954 B2 * 4/2013 Sturm ..... B63B 7/085 440/21
8,613,692 B2 12/2013 Baudhuin
8,632,446 B2 1/2014 Solow et al.
8,968,162 B2 * 3/2015 Jaguan ..... A63B 71/023 482/57
D740,041 S * 10/2015 Chadwick ..... D6/352
2003/0236156 A1 * 12/2003 Finch ..... A63B 21/0605 482/142
2004/0248714 A1 12/2004 Johnsen
2005/0143235 A1 * 6/2005 Park ..... A63B 21/055 482/142
2007/0270292 A1 * 11/2007 Laney ..... A63B 21/4047 482/121
2008/0076641 A1 * 3/2008 Sheehan ..... A63B 21/0552 482/92
2008/0081748 A1 * 4/2008 Knapp ..... A63B 21/0552 482/130
2009/0233773 A1 9/2009 Cardey
2011/0105287 A1 5/2011 Taylor
2013/0005550 A1 1/2013 Nagy
2013/0190149 A1 * 7/2013 Carraway ..... A63B 23/02 482/140

OTHER PUBLICATIONS

Wireless Extension cords, http://www.thinkgeek.com/stuff/41/wec.shtml.

* cited by examiner

*Primary Examiner* — Stephen Crow
(74) *Attorney, Agent, or Firm* — The Keys Law Firm PLLC

(57) ABSTRACT

A multipurpose exercise stool for enabling aerobic and anaerobic exercise for a user seated thereon comprises a base member for providing a lower level having four wheels, a main body disposed over the base and a cushion member disposed over the main body. These parts are connected through a vertical swivel pole which is connected to the bottom of the cushion member, passes through the main body, and connects to the top of the base member. An internal base axle passes through the main body horizontally. A rod assembly may be attached to the base axle on either end as it exits the main body and two pedal assemblies can be attached to the base axle on the inside of the main body at one end and extend from the main body at the other end.

17 Claims, 2 Drawing Sheets

MULTIPURPOSE EXERCISE STOOL

BACKGROUND OF THE INVENTION

1. Field of the Invention

This invention relates generally to exercise devices and, more particularly, to an exercise device embodied as a stool having swivel capabilities.

2. Description of the Prior Art

The use of various exercise devices to perform movements aimed at increasing one's strength or stamina is well established. While it is common to see individuals using devices such as treadmills or stationary bikes to improve stamina, it is equally common to see individuals use devices such as row machines and leg presses to increase strength. A problem which still exists, however, is conventional exercise devices typically are unable to be used to improve one's strength and endurance through different part of the body. As such, users typically must move from device to device to exercise their entire body, or limit their exercise target to strengthening or improving endurance on one particular area of the body. Thus, there remains a need for a multipurpose exercise stool which can be configured to enable a user to work out a plurality of areas on the body. It would be helpful if such a multipurpose exercise stool included a plurality of attachable parts for targeted specific areas of the body. It would be additionally desirable for such a multipurpose exercise stool enabled a user to exercise while seated.

The Applicant's invention described herein provides for a multipurpose exercise stool adapted to allow a user to exercise several areas of the body for strength and endurance. The primary components in Applicant's multipurpose exercise stool are a modified stool, a plurality of poles, a back rest, and a plurality of pedals. When in operation, the multipurpose exercise stool enables the performance exercises from a seated position which target different areas of the body. As a result, many of the limitations imposed by prior art structures are removed.

SUMMARY OF THE INVENTION

A multipurpose exercise stool for enabling aerobic and anaerobic exercise for a user seated thereon. The multipurpose exercise stool comprises a base member for providing a lower level having four wheels, a main body disposed over the base and a cushion member disposed over the main body. These parts are connected through a vertical swivel pole which is connected to the bottom of the cushion member, passes through the main body, and connects to the top of the base member. An internal base axle passes through the main body horizontally. A rod assembly may be attached to the base axle on either end as it exits the main body and two pedal assemblies can be attached to the base axle on the inside of the main body at one end and extend from the main body at the other end. The rod assemblies enable press and row motion, while the pedal assemblies enable circular bicycle style motion.

It is an object of this invention to provide a multipurpose exercise stool which can be configured to enable a user to work out a plurality of areas on the body.

It is another object of this invention to provide a multipurpose exercise stool that includes a plurality of attachable parts for targeted specific areas of the body.

It is yet another object of this invention to provide a multipurpose exercise stool that enables a user to exercise while seated.

These and other objects will be apparent to one of skill in the art.

DETAILED DESCRIPTION OF THE INVENTION

Figure 1:
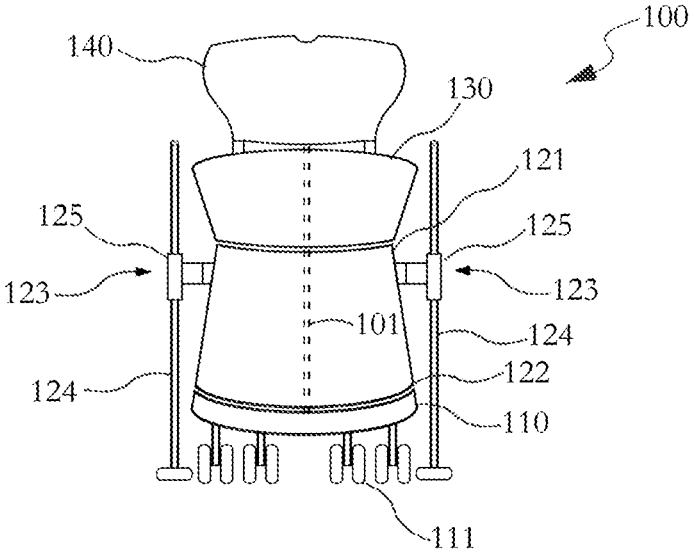
FIG. 1 is a side elevational view of a multipurpose exercise stool built in accordance with the present invention.

Referring now to the drawings and in particular FIG. 1, a multipurpose exercise stool 100 is shown having a base member 110, a main body 120, and a cushion member 130 which are each circular and arranged stacked on top of one another. The base member 110 is provides the lower level and includes four wheels 111. The main body 120 is disposed over the base member 110 and connected thereto through a vertical swivel pole 101 which extends from and is connected to the bottom of the cushion member 130 to the top of the base member 110. The cushion member 130 is disposed over the main body 120. Attachable to the top side of the cushion member 130 is a back rest 140.

Extending out of each side of the main body 120 is a rod assembly 123. The rod assembly 123 is defined by a elongated pole 124 and pole holder 125, with the pole holder 125 attached to the side of the main body 120. The rod assembly 123 is connected to an internal base axle, the structure of which is discussed in more detail below.

Figure 2A:
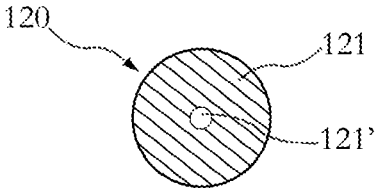
FIG. 2A is a top plan view of the main body of a multipurpose exercise stool built in accordance with the present invention.
Figure 2B:
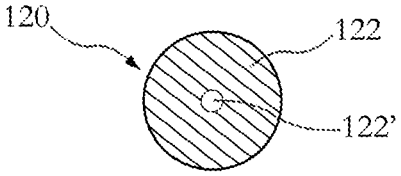
FIG. 2B is a bottom plan view of the main body of a multipurpose exercise stool built in accordance with the present invention.

Referring now to FIGS. 1, 2A and 2B, while the main body 120 is structurally hollow, its top side 121 and its bottom side 122 are each defined by a cap surface which substantially encloses the main body 120. On the top side 121 and the bottom side 122, the only opening in the main body 120 is a top aperture 121' in the cap surface of the top side 121 and a bottom aperture 122' in the cap surface of the bottom side 122. The top aperture 121' and the bottom aperture 122' enable the vertical swivel pole to pass through the main body 120, so as to connect the base member 110, main body 120 and the cushion member 130, and remain in a fixed, vertical position in between its connection to the bottom of the cushion member 130 to the top of the base member 110.

Figure 3:
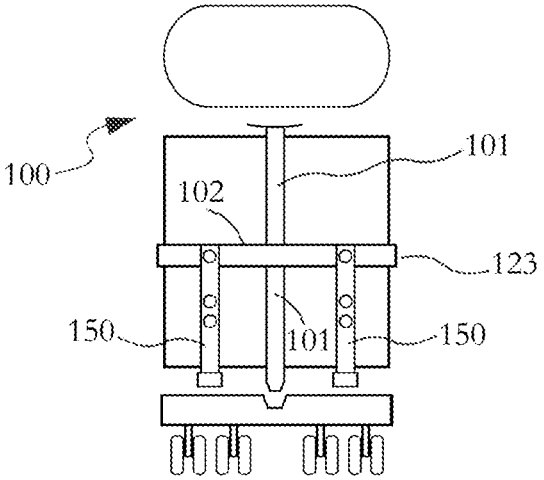
FIG. 3 is an exploded side elevational view of cross section of a multipurpose exercise stool in accordance with the present invention with the swivel spine engaged.

Referring now to FIG. 3, the primary structural frame of the multipurpose exercise stool 100 is defined by the vertical swivel pole 101 which pivotally engages the top of the base member 110, passes through the main body 120, and is attached to the bottom of the cushion member 130. The swivel pole 101 engages the base member 110 in a manner which enables it to be rotated about its center axis and swing from its vertical alignment to be diagonal relative to the base member 110. Through this action, a user seated on the multipurpose exercise stool 100 and spin or lean the cushion member 130.

The internal base axle 102 passes horizontally through the main body 120. The internal base axle 102 is positioned in the main body 120 so that it can freely rotate in either direction, typically in response to manual pressure from a pedal assembly 150 or from the rod assembly 123.

Figure 4:
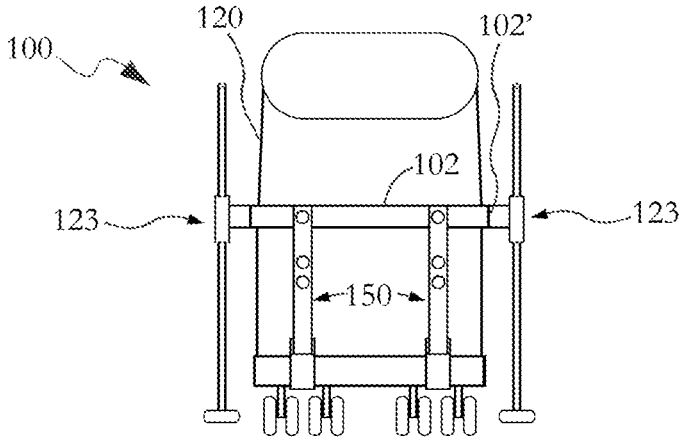
FIG. 4 is a side perspective view of cross section of the base portion of a multipurpose exercise stool built in accordance with the present invention with the foot pedal assembly engaged.
Figure 5:
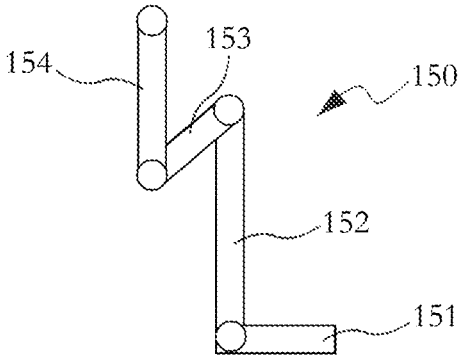
FIG. 5 is a side elevational view of the foot pedal assembly of a multipurpose exercise stool built in accordance with the present invention.
Figure 6:
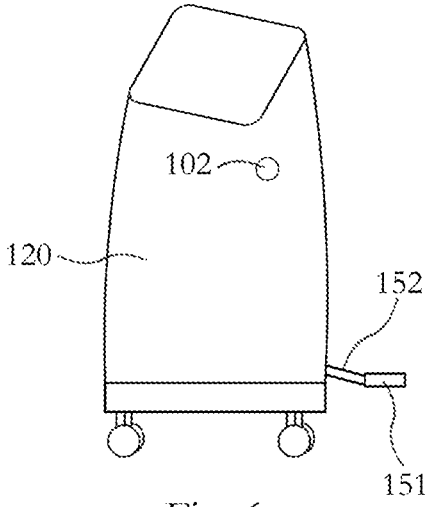
FIG. 6 is a front elevational view of the base portion of a multipurpose exercise stool built in accordance with the present invention with the foot pedal assembly engaged

Referring now to FIGS. 4, 5, and 6, a full featured multipurpose exercise stool 100 includes two attached pedal assemblies 150 and two rod assemblies 123 attached to the main body 120. The pedal assemblies 150 are each defined by a foot pedal 151, a first hinge member 152, a second hinge member 153 and a third hinge member 154, each hingedly attached sequentially. The third hinge member 154 is fixed to the internal base axle 102 such rotation of the internal base axle 102 causes it to move reciprocally. Through the second hinge member 153 and the first hinge member 152, this reciprocal movement is transferred to the pedal 151. Conversely, when a user presses down on the pedal 151, reciprocal movement is transferred to the internal base axle 102. In this regard, each pedal assembly 150 is mounted to opposing sections of the internal base axle 102 so that the reciprocal movement of one pedal 154 is opposite that other, in a similar manner as a conventional bicycle pedal or elliptical machine pedal.

The rod assemblies 123 are also attached to the internal base axle 102 through a bearing member 102' such that any swinging motion of rod assemblies 123 from manual force is not transferred to the internal base axle 102 and any rotation of the internal base axle 102 is not transferred to the rod assemblies 123. This construction enables the pedal assemblies 150 to be repeatedly engaged by a user without causing the multipurpose exercise stool 100 to move, enabling aerobic exercise. Aerobic exercise for the upper body is attained by swinging the rod assemblies 123, without having them contact the ground. Anaerobic exercise is enabled in the upper body by swinging the rod assemblies 123 either forward or backward, together or alternating, to moved the multipurpose exercise stool 100 forward, backward, in circle, spinning, with the user's weight on the multipurpose exercise stool 100 creating the resistance. Anaerobic exercise is enabled in the lower body by using ones legs to move the multipurpose exercise stool 100 while seated on it, with the user's weight on the multipurpose exercise stool 100 creating the resistance.

It is contemplated that the multipurpose exercise stool 100 may include seating attachments which can be used in place of the cushion member. In one embodiment, a half Swiss ball can be used in place of the cushion member, enabling a user to perform conventional seated Swiss ball exercises.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multipurpose exercise stool for performing exercises while seated, comprising:

a base member having a top portion and a bottom portion;

a main body disposed over the base member, wherein the main body is defined by a hollow body having a top side and a bottom side;

a seating portion disposed over the main body, wherein said seating portion includes a seating side and a connecting side;

a vertical swivel pole, wherein said vertical swivel pole is connected to the top portion of the base member and the connecting side of the seating portion and said vertical swivel pole passes through a top aperture in the top side and an bottom aperture in the bottom side of said main body;

an internal base axle which passes horizontally through the hollow body and is positioned to freely rotate about its center axis; and at least one pedal assembly attached to said base axle, wherein said pedal assembly includes pedal which extends from the main body.

2. The multipurpose exercise stool of claim 1, additionally comprising a plurality of wheels on bottom portion of base member.

3. The multipurpose exercise stool of claim 1, wherein said vertical swivel pole is movably attached to the base member, thereby enabling the vertical member to rotate about a center axis and swing from a vertical alignment to be diagonal position relative to the base member.

4. The multipurpose exercise stool of claim 1, wherein the seating portion is defined by a cushion member.

5. The multipurpose exercise stool of claim 1, additionally comprising a rod assembly extending from either side of the main body, attached to each end of the base axle.

6. The multipurpose exercise stool of claim 5, additionally comprising a back rest attached to the seating portion.

7. The multipurpose exercise stool of claim 1, additionally comprising a back rest attached to the seating portion.

8. A multipurpose exercise stool for performing exercises while seated, comprising:

a base member having a top portion and a bottom portion;

a main body disposed over the base member, wherein the main body is defined by a hollow body having a top side and a bottom side;

a seating portion disposed over the main body, wherein said seating portion includes a seating side and a connecting side;

a vertical swivel pole, wherein said vertical swivel pole is connected to the top portion of the base member and the connecting side of the seating portion and said vertical swivel pole passes through a top aperture in the top side and an bottom aperture in the bottom side of said main body;

an internal base axle which passes horizontally through the hollow body and is positioned to freely rotate about its center axis; and a rod assembly extending from either side of the main body, attached to each end of the base axle.

9. The multipurpose exercise stool of claim 8, wherein each rod assembly is defined by an elongated pole attached to a pole holder.

10. The multipurpose exercise stool of claim 8, additionally comprising a plurality of wheels on bottom portion of base member.

11. The multipurpose exercise stool of claim 8, wherein said vertical swivel pole is movably attached to the base member, thereby enabling the vertical member to rotate about a center axis and swing from a vertical alignment to be diagonal position relative to the base member.

12. The multipurpose exercise stool of claim 8, wherein the seating portion is defined by a cushion member.

13. The multipurpose exercise stool of claim 8, additionally comprising a back rest attached to the seating portion.

14. A multipurpose exercise stool for performing exercises while seated, comprising:

a base member having a top portion and a bottom portion;

a main body disposed over the base member, wherein the main body is defined by a hollow body having a top side and a bottom side;

a seating portion disposed over the main body, wherein said seating portion includes a seating side and a connecting side;

a vertical swivel pole, wherein said vertical swivel pole is connected to the top portion of the base member and the connecting side of the seating portion and said vertical swivel pole passes through a top aperture in the top side and an bottom aperture in the bottom side of said main body; and a back rest attached to the seating portion.

15. The multipurpose exercise stool of claim 14, additionally comprising a plurality of wheels on bottom portion of base member.

16. The multipurpose exercise stool of claim 14, wherein said vertical swivel pole is movably attached to the base member, thereby enabling the vertical member to rotate about a center axis and swing from a vertical alignment to be diagonal position relative to the base member.

17. The multipurpose exercise stool of claim 14, wherein the seating portion is defined by a cushion member.

* * * * *